US005586947A

United States Patent [19]

Hutin

[11] Patent Number: 5,586,947

[45] **Date of Patent: *Dec. 24, 1996**

[54] GOLF CLUBHEAD AND GOLF CLUB FITTED WITH SUCH A HEAD

[75] Inventor: Patrice Hutin, Annecy le Vieux, France

[73] Assignee: Skis Rossignol SA, France

[ * ] Notice: The term of this patent shall not extend beyond the expiration date of Pat. No. 5,299,807.

[21] Appl. No.: 408,162

[22] Filed: Mar. 21, 1995

[30] Foreign Application Priority Data

Mar. 22, 1994 [FR] France ..... 94 03620
Mar. 22, 1994 [FR] France ..... 94 03621

[51] Int. Cl.[6] ..... A63B 53/04

[52] U.S. Cl. ..... 473/324; 473/332; 473/329; 473/345; 473/350

[58] Field of Search ..... 273/78, 167 H, 273/173, 167 R, 168, 167 A, 164.1; 473/324, 332, 329, 345, 350

[56] References Cited

U.S. PATENT DOCUMENTS

| | | | |
|---|---|---|---|
| 4,928,972 | 5/1990 | Nakanishi et al. | 273/78 |
| 5,299,807 | 4/1994 | Hutin | 273/173 |
| 5,316,298 | 5/1994 | Hutin et al. | 273/78 |

*Primary Examiner*—V. Millin
*Assistant Examiner*—Charles W. Anderson
*Attorney, Agent, or Firm*—Parkhurst, Wendel & Burr, L.L.P.

[57] ABSTRACT

A golf clubhead (3) including a front strike face (5), a sole (6) extending rearwardly from the base of the strike face (5), and a vibration damper (10) mounted at least on one side of the head and including a stress plate (11) and a visco-elastic layer (12), wherein at least one of the two components (11, 12) of the vibration damper (10) has at least one opening therethrough.

33 Claims, 8 Drawing Sheets

FIG. 9
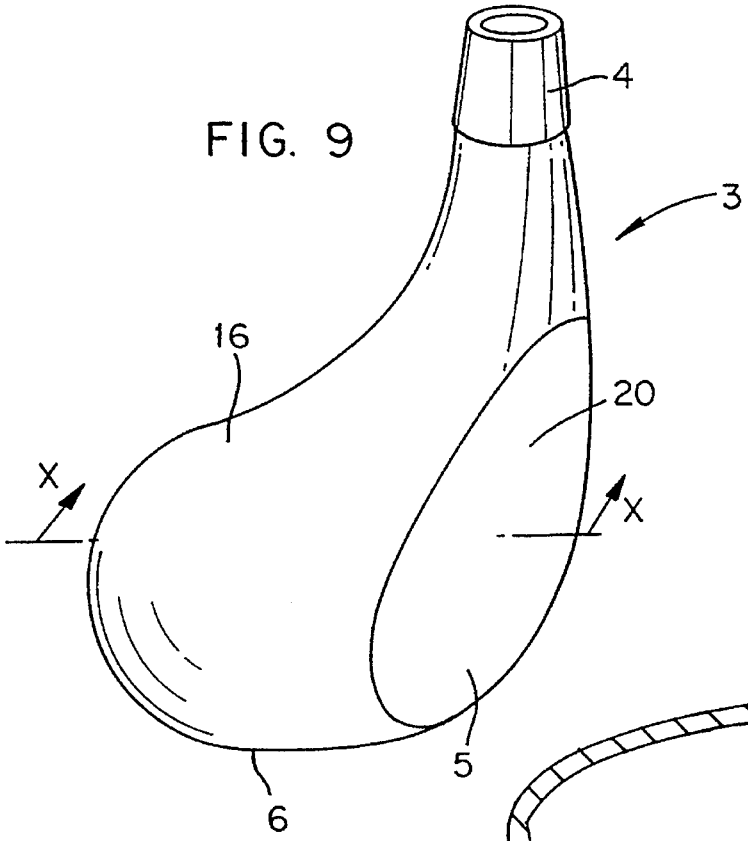
FIG. 10
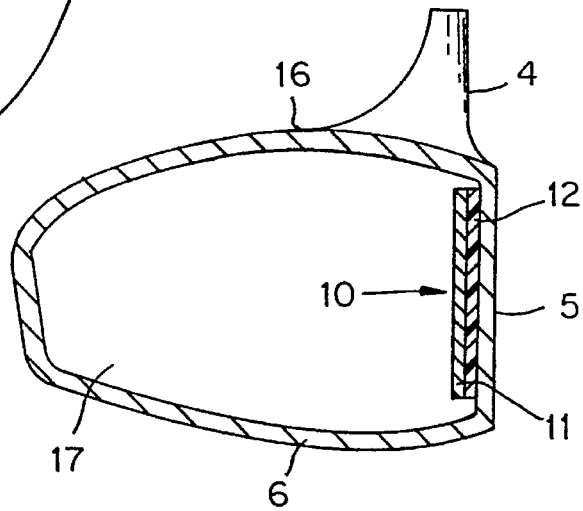
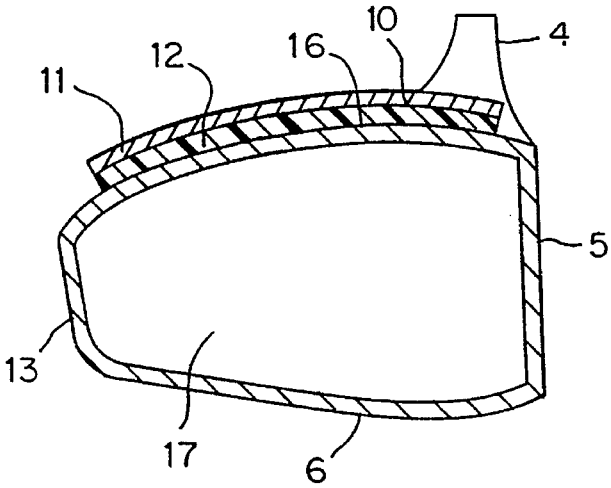
FIG. 11

GOLF CLUBHEAD AND GOLF CLUB FITTED WITH SUCH A HEAD

BACKGROUND OF THE INVENTION

The invention relates to an improved golf clubhead, golf clubs fitted with such heads, and, in particular, irons fitted with such heads.

It is known that a golf clubhead linked to a shaft includes a front strike face, a sole at the base extending rearwardly from the strike face, and a rear surface opposite to the strike face. Depending on the manufacturer, the desired results and the manufacturing method, the rear surface may assume many different shapes.

Illustratively for "wood" clubs, the rear surface is convex, whereas for "iron" clubs it is becoming increasingly hollowed (i.e., so-called "cavity-back" clubs).

U.S. Pat. 5,316,298 describes a golf clubhead wherein the rear surface furthermore is fitted with a vibration damper including a constraining plate linked to the rear surface by a visco-elastic layer. As a result, vibrations generated at impact between the clubhead and a golf ball are attenuated. Besides improving the technical features of the club regarding comfort and accuracy, this device also decreases acoustic-resonance phenomena resulting from the aforementioned impact.

SUMMARY OF THE INVENTION

The invention relates to improving the above-discussed golf clubhead by providing at least one opening passing through at least one of the two components of the vibration damper. The invention differs from the technical state of the art in that the vibration damper no longer is solid but instead assumes a peripheral, annular or hollowed shape. Consequently, it is possible not only to achieve the desired vibration attenuation and to improve tactile feel, but also to improve the peripheral distribution of the weight of the golf clubhead without thereby significantly shifting the center of gravity, a condition which is always desirable to secure better impact tolerance, especially for average or fairly inexperienced players.

It is known that this type of constraining plate vibration damper operates due to the substantial deformation of the visco-elastic layer compared to the relative rigidity of the constraining plate. The shearing effects at the edges of the vibration damper absorb part of the energy of vibration created at the point of impact. By using a vibration damper having a peripheral, annular or hollowed shape, this edge-effect is enhanced. As a result, energy absorption zones are increased and thereby the device effectiveness is substantially improved.

In practice, and with regard to the nature of the vibration damper components, in the manner already stated in U.S. Pat. No. 5,316,298 cited above, the constraining plate advantageously is an annular and rigid plate with a Young's modulus exceeding 10,000 MPa, preferably exceeding 50,000 MPa, and advantageously near 72,000 MPa, its thickness being from 0.07 to 2.0 mm. The visco-elastic layer is less than 3 mm thick and its intrinsic shock absorption (tangent $\delta$) is between 0.4 and 1.2.

In the case of an "iron" club, the rear surface comprises a cavity above the sole, the forwardmost portion of the cavity being generally parallel to the strike face, and the annular vibration damper of the invention is preferably seated in the cavity.

In the case of a putter, the vibration damper is located either on the rear surface or on the top side of the sole, or if the cross-section of the putter is in the form of a prone U, on top of the upper arm.

In the case of a "metal-wood" club, the vibration damper is preferably located on the top side of the head or on an inner side of the cavity forming the head, or, if so desired, on the lateral outer sides. In one variation, the vibration damper may be located on the strike face either to enclose the impact zone or on lateral areas of the impact zone.

In all kinds of clubs, the vibration damper of the invention may include an adapter fitting the hosel to the head. Accordingly, the vibration damper is located on at least two adjacent sides of the head, in particular at the top of the strike face and on the front edge of the upper side. In this instance, placement is made easier by using a shock absorber with a cutout, such as is shown in FIG. 21 discussed later herein.

In another variation, the visco-elastic sheet may consist of several superposed elementary visco-elastic foils of different properties. The damping properties of each one are temperature offset at a given vibrational frequency or they are frequency-offset at a given temperature.

In yet another variation, the visco-elastic foil consists of a main-plane juxtaposition of elementary zones each exhibiting damping properties equally offset in frequency and temperature.

BRIEF DESCRIPTION OF THE INVENTION

The following illustrative embodiments and the attached drawings exemplify the manner in which the invention can be implemented and the ensuing advantages thereof.

FIG. 9 is a perspective view of a conventional "metal wood" head wherein the locations of the vibration damper are shown in section in FIGS. 10 and 11.

FIG. 15 shows a vibration damper wherein the two components include an opening, whereas

DETAILED DESCRIPTION OF THE INVENTION

Figure 1:
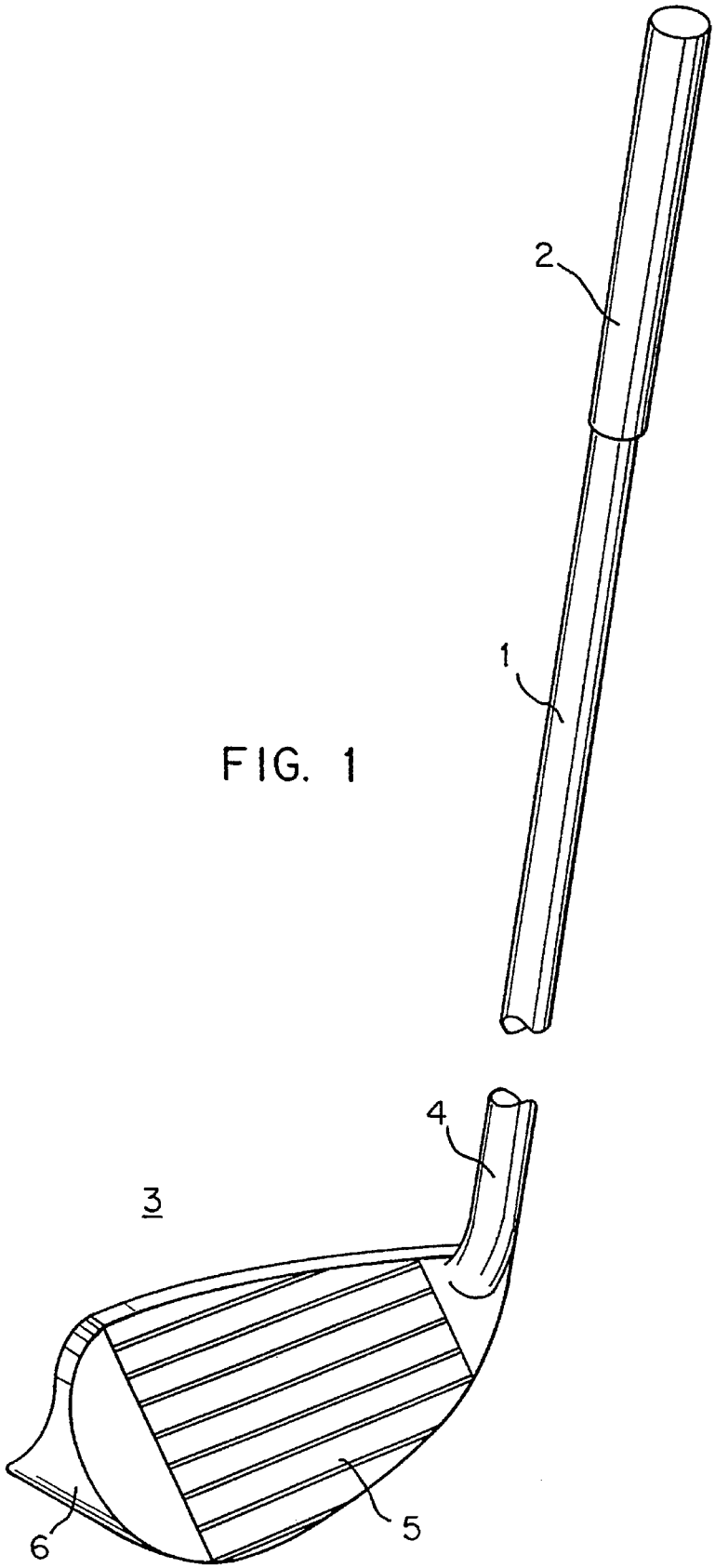
FIG. 1 is a perspective view of a so-called "iron" golf club.
Figure 2:
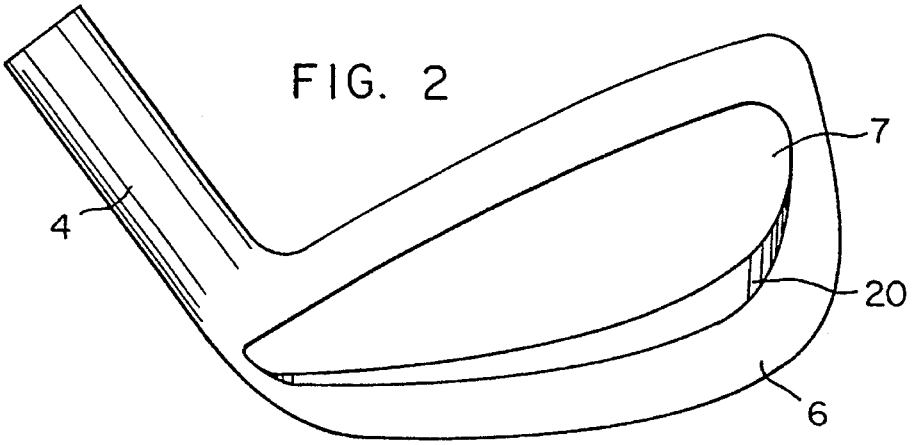
FIG. 2 shows the rear surface of the clubhead of the club shown in FIG. 1.

FIG. 1 shows a conventional golf iron (a mold-cast iron) of the invention including a shaft 1, made for instance of metal or reinforced plastic, terminating at its free end in a grip 2 and connected at its lower end by a hosel 4 to a head denoted by the overall reference 3 of which the weight and shape vary with the iron number. The cross-section of this head is approximately L-shaped. The head includes on its front surface, constituting the larger arm of the L, a wall having an external, planar, striated strike face 5, and a sole 6 forming the small leg of the L. The wall constituting the longer arm of the L has a thickness of, for example, 5 mm. The head 3 further includes a rear surface 7 subtending a cavity the shape of which varies with the manufacturer and the desired results. The rear surface 7 assumes a generally rounded elliptical shape with major and minor axes of about 60 mm and 30 mm, respectively.

Figure 3:
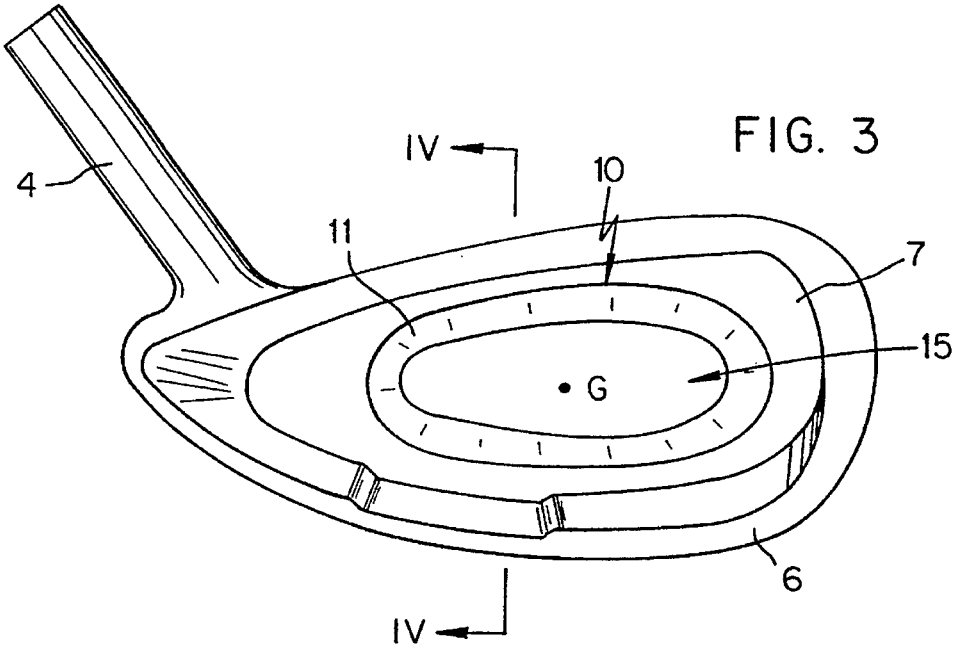
FIG. 3 is a head of the invention also shown in rear view and FIG. 4 is a section along the axis IV–IV' of FIG. 3.
Figure 4:
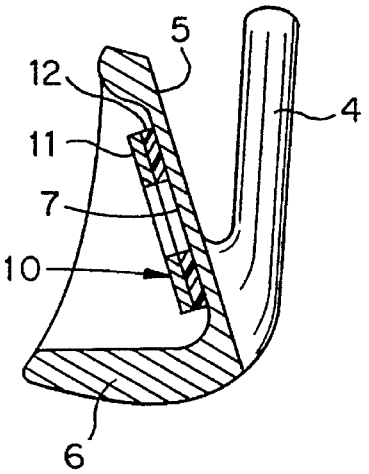

In the invention, the cavity receives a hollowed vibration damper denoted by the overall reference 10 offset from the end of the cavity. In the embodiment of FIGS. 3 and 4, the annular vibration damper 10 has an overall elliptical shape about 40 mm and 20 mm long along the major and minor axes, and subtends a hollowed central opening 15 which is also elliptical.

The vibration damper 10 includes a rigid constraining plate 11 made of, for example, an aluminum alloy commercially known as ZICRAL and manufactured by CEGEDUR PECHINEY with a Young's modulus of 70,000 MPa. The rigid plate is about 0.8 mm thick and weighs about one gram. The annular rigid plate 11 is associated with a visco-elastic high damping sheet 12. The outer and inner surfaces of the sheet 12 are coated with a fine layer of adhesive to enhance adhesion between the visco-elastic sheet 12 and the rigid plate 11 on the one hand, and the visco-elastic sheet 12 and the rear surface 7 of the head 3 on the other hand. The visco-elastic sheet is made of a rubber, such as modified butylonitrile, is preferably about 0.3. mm thick and preferably exhibits a damping coefficient (tan $\delta$) between 0.4 and 1.2, more preferably between 0.6 and 0.8.

The vibration damper 10 of the invention is mounted on the rear surface 7 and is centered about the center of gravity G of the clubhead 3, that is, it is aligned with the ideal impact point when strike a golf ball. The ratio of the cross-sectional area of the opening 15 provided in the vibration damper 10 to the cross-sectional area of the outer contour of the vibration damper 10 is between about 0.1 and 0.9, preferably about 0.5. If the ratio is less than 0.1, the opening 15 is very small and located in a central zone where deformations are small, as a result of which the additional edge effect is negligible. On the other hand, if the ratio exceeds 0.9, the width of the constraining plate 11 is too small and thus can no longer act as a rigid element.

Figure 5:
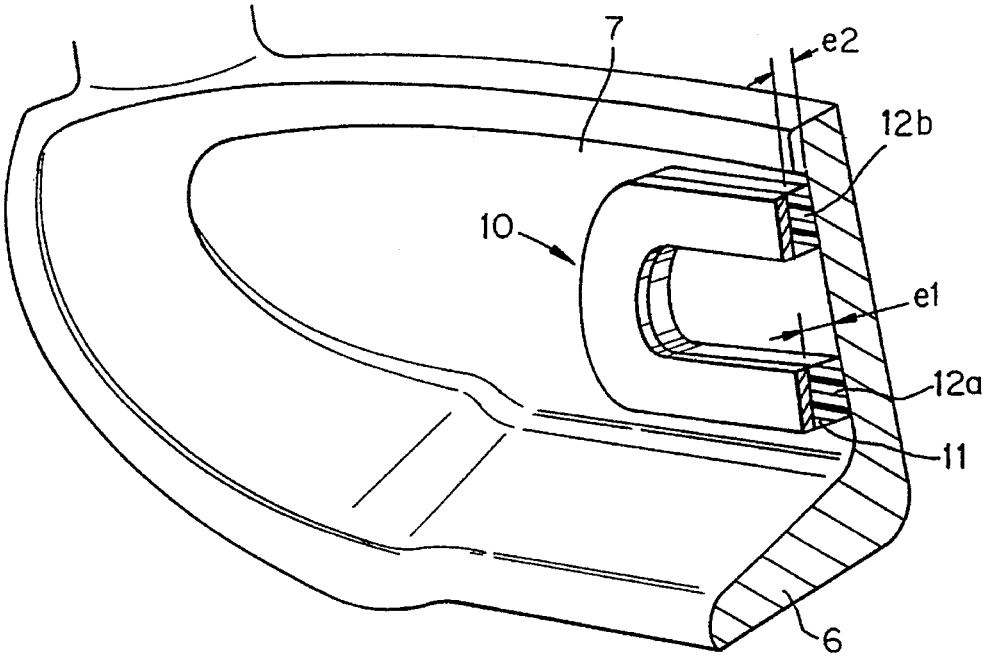
FIGS. 5 through 8 are sectional perspective views of an "iron" fitted with various embodiments of the vibration damper of the present invention.
Figure 6:
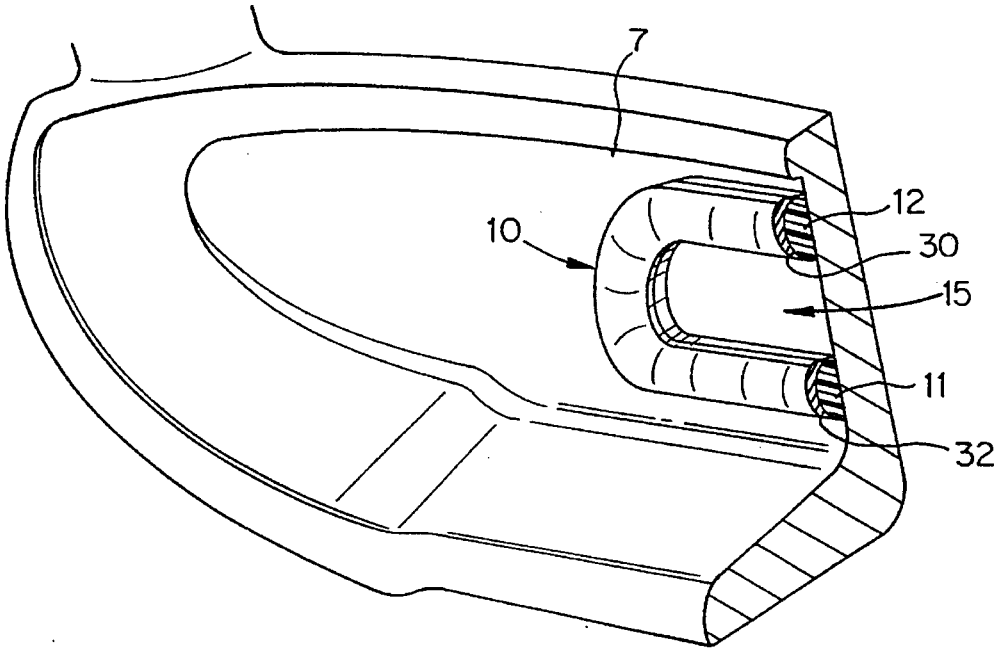
Figure 7:
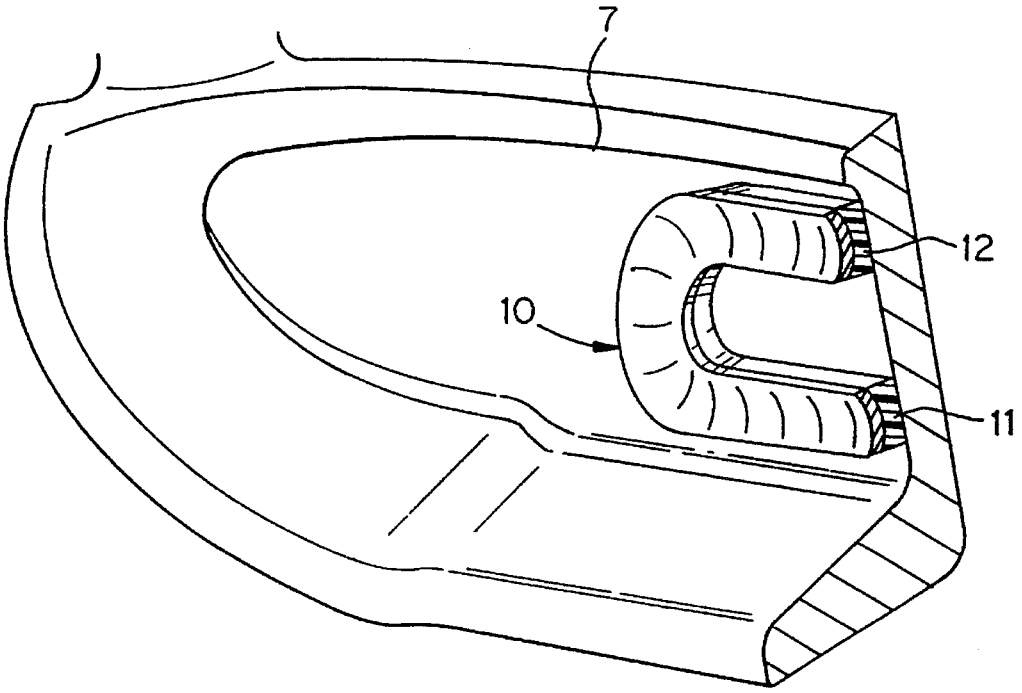

In the embodiment shown in FIG. 5 and relating to irons, the constraining plate 11 is not parallel to the rear surface 7, and accordingly the thickness of the visco-elastic layer 12 varies substantially linearly from $e_1$ at 12*a* near the sole 6 to $e_2$ at 12*b*. In the embodiments shown in FIGS. 6, 7, 25 and 26, the thickness of the annular vibration damper 10 varies between the radially inner portion thereof adjacent the contour 30 of the opening 15 and the external contour 32 of the vibration damper 10. Specifically, in the embodiments of FIGS. 6, 7, 25 and 26, the shape of the vibration damper is such that its cross-section, defined between the contour 30 of the opening 15 and the external contour 32, follows a concave or convex shape. Half concave shapes or half convex shapes may be used within the scope of the present invention.

Figure 8:
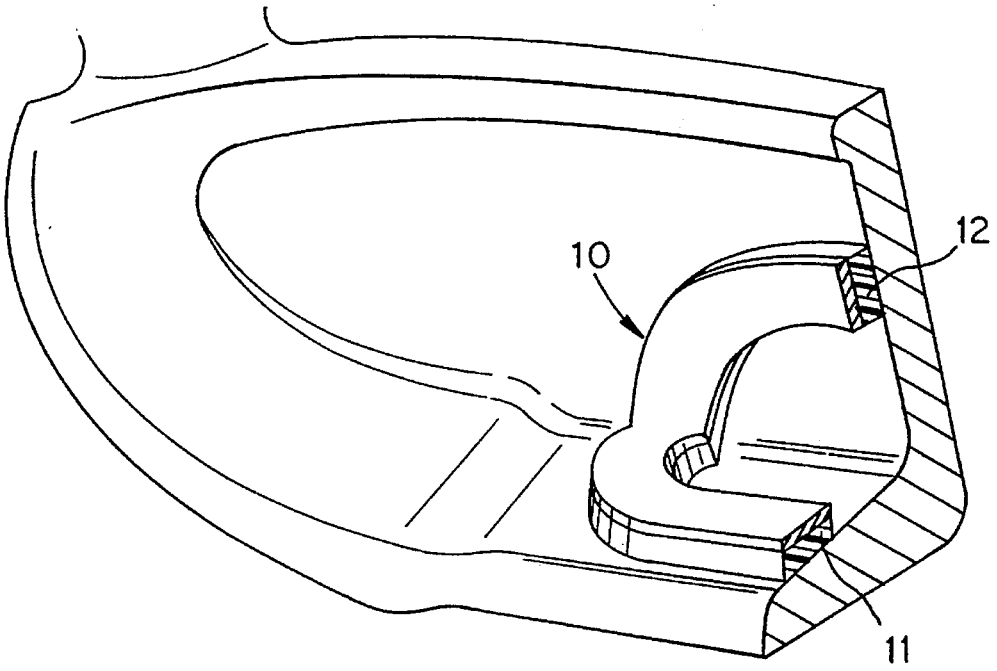

In FIG. 8, the vibration damper is mounted on the rear surface 7 so that a portion thereof is generally parallel to the strike face 5 and a portion thereof is generally parallel to the sole 6.

In the embodiments shown in FIGS. 9 through 11, the vibration damper 10 is used on a "metal-wood" club. A "metal-wood" head comprises a hosel 4, strike face 5, a sole 6, a rear surface 13, an upper side 16 and a cavity 17. The section in the plane defined by the axis X–X' of FIG. 9 is shown generally in FIG. 10. The vibration damper may be mounted inside the cavity 17 on any and all inner surfaces of the clubhead. For example, the vibration damper can be mounted to the rear surface of the strike face 5 (FIG. 10) or mounted on the top of the upper side 16 (FIG. 11).

Figure 12:
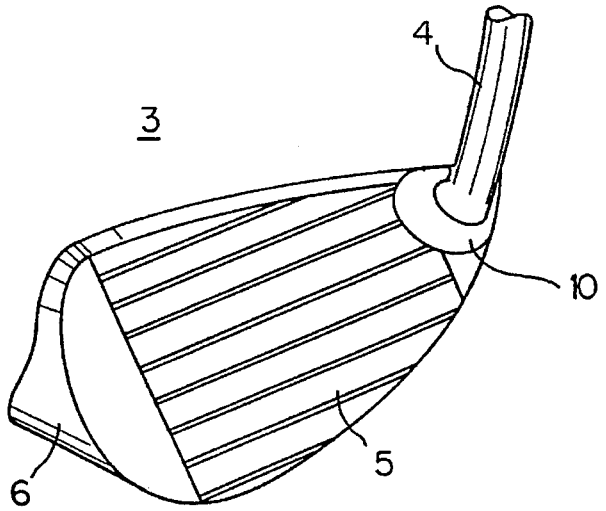
FIG. 12 shows a head fitted with a vibration damper placed around the hosel.
Figure 13:
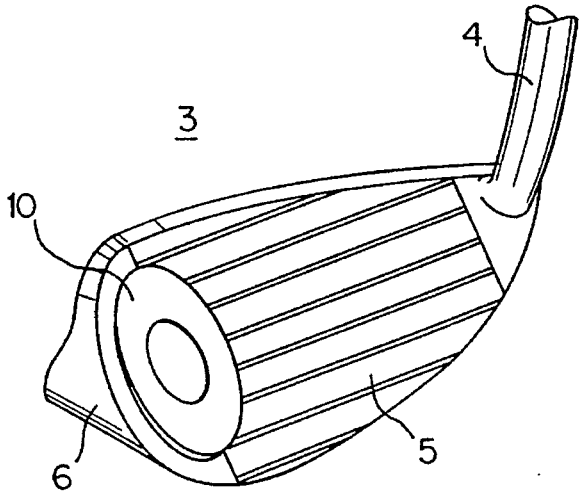
FIGS. 13 and 14 illustrate various embodiments of the invention wherein the vibration damper is placed on the strike face.
Figure 14:
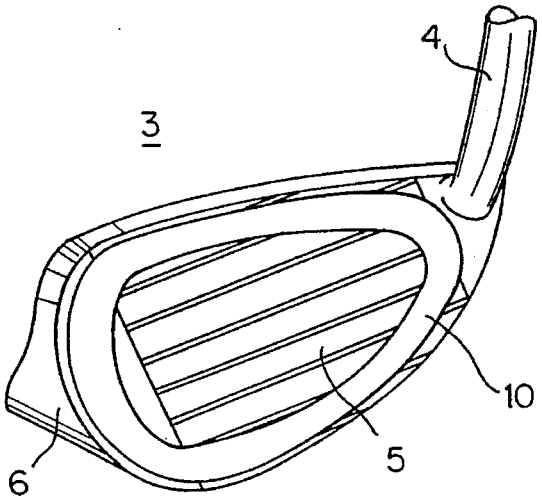

In the embodiments shown in FIGS. 12 through 14, the vibration damper 10 occupies part of the strike face 5. In FIG. 12 the vibration damper 10 is implanted at the base of the hosel 4, which it encloses, at the junction zone between the hosel and the strike face 5. This design is especially effective in minimizing the transmission of vibrations into the shaft.

In FIG. 13, the vibration damper is mounted on the front surface of the clubhead near the toe portion of the strike face 5, whereas in FIG. 14 the vibration damper is mounted on the front surface of the clubhead surrounding the impact zone of the strike face 5.

Figure 15:
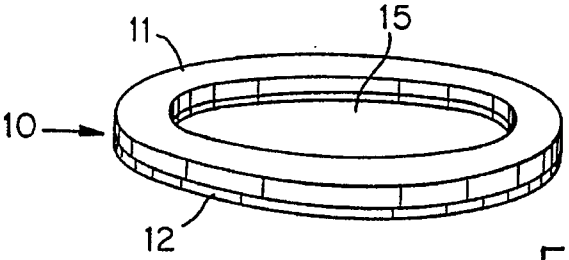
Figure 16:
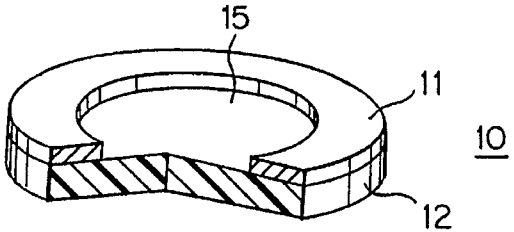
FIGS. 16 and 17 illustrate one of the two components being solid.
Figure 17:
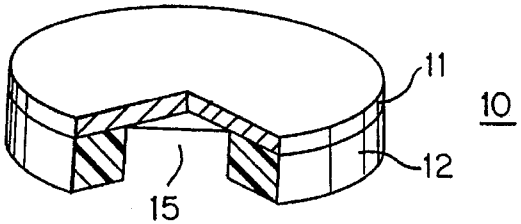

In the embodiment of FIG. 15, the constraining plate 11 and the visco-elastic layer 12 assume identical shapes and the openings 15 through each are superposed. In the embodiment of FIG. 16, the constraining plate 11 includes one opening 15 therethrough and is associated with a visco-elastic layer 12 of which the surface is solid. In the embodiment of FIG. 17, the constraining plate 11 is solid and connected to the golf clubhead by a visco-elastic layer 12 with one or more openings 15 therethrough.

Figure 18:
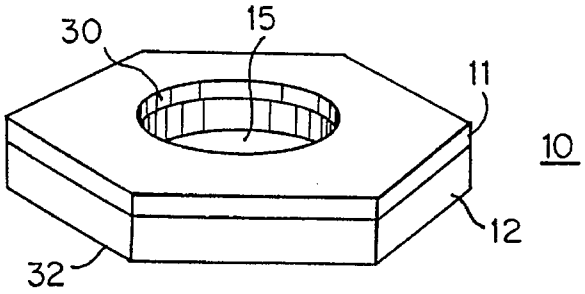
FIGS. 18 through 20 illustrate various shape and position embodiments regarding the contours of the opening and of the vibration damper.
Figure 19:
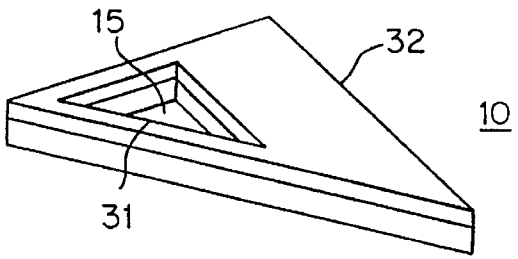
Figure 20:
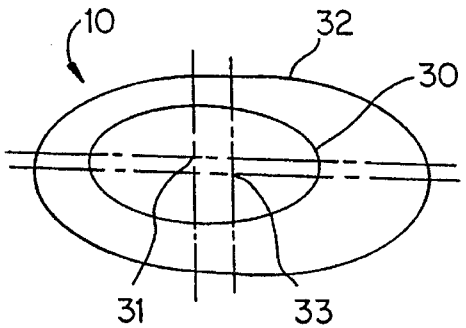

The external contour of the vibration damper 10 and the contour of the opening 15 may assume various shapes, namely circular, elliptical, oval or polygonal (FIGS. 18 and 19). Various shapes may be combined when selecting the external contour of the vibration damper and the contour of the opening 15. In the embodiments of FIGS. 19 and 20, the external contour 32 of the vibration damper 10 and the opening contour 30 are offset relative to each other. Moreover, FIG. 20 shows that the contour 30 of the opening 15 and the external contour 32 of the vibration damper 10 subtend different centers 31, 33.

Figure 21:
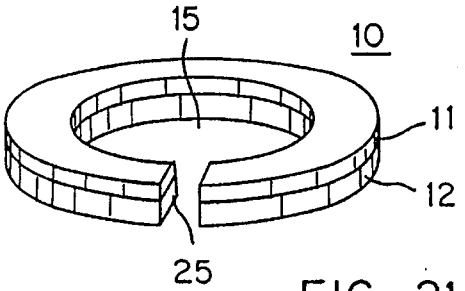
FIGS. 21 through 23 show further embodiments of the invention.

In the embodiment of FIG. 21, the opening 15 communicates with the external contour 32 of the vibration damper 10 through an aperture 25 which is small compared to the overall golf clubhead, so that the term "opening" may be used even though there is only one contour.

Figure 22:
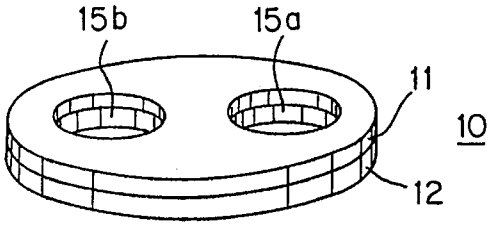
Figure 23:
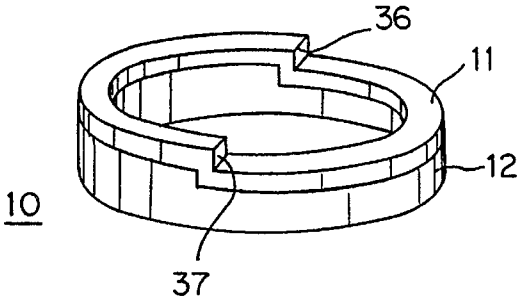
Figure 24:
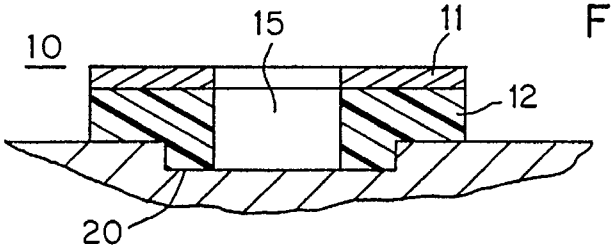
FIGS. 24 through 26 are sections illustrating various shape embodiments of the invention.
Figure 25:
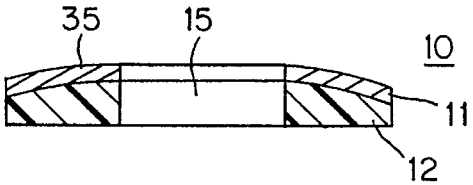
Figure 26:
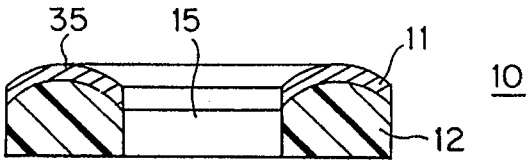

In the embodiment of FIG. 22, the vibration damper 10 is elliptical and includes two circular openings 15*a* and 15*b* located symmetrically about the minor axis of the ellipse. In the embodiment of FIG. 23, both the constraining plate 11 and the upper surface of the visco-elastic layer 12 include offset surface portions 36 and 37. In the embodiment of FIG. 24, the vibration damper 10 fills a matching seat 20 in a central portion of the rear surface 7 of the clubhead and extends radially outwardly beyond the seat 20 on the rear surface 7.

The vibration damper of the present invention substantially reduces impact vibrations and more rapidly absorbs the most irritating vibrations. Moreover, the annular design of the vibration damper of the invention reduces the weight of the damper, and hence the influence thereof, on the center of gravity of the clubhead. In some cases, however, where irons are concerned, the weight distribution is moved even farther toward the head periphery without thereby significantly changing the location of the center of gravity of the clubhead. Thereby the club is more tolerant of off-center impacts. Finally, the club also plays more comfortably because vibrations transmitted into the arms of the user are attenuated and resonance is substantially lowered.

What is claimed is:

1. A golf clubhead comprising:

a front strike faces a sole extending rearwardly from a bottom region of said front strike face; and vibration damping means provided on at least one surface of the clubhead and comprising constraining means connected to said at least one surface by at least one layer of visco-elastic material, wherein at least one of said constraining means and said at least one layer of visco-elastic material has at least one opening therethrough.

2. The golf clubhead of claim 1, wherein said constraining means has said at least one opening passing therethrough.

3. The golf clubhead of claim 1, wherein said at least one layer of visco-elastic material has said at least one opening passing therethrough.

4. The golf clubhead of claim 1, wherein said constraining means comprises a rigid plate.

5. The golf clubhead of claim 4, wherein each of said rigid plate and said at least one layer of visco-elastic material has at least one opening passing therethrough.

6. The golf clubhead of claim 5, wherein said rigid plate and said at least one layer of visco-elastic material have the same shape and the openings passing therethrough are superposed.

7. The golf clubhead of claim 4, wherein an external surface of said rigid plate opposite said visco-elastic material is convex.

8. The golf clubhead of claim 4, wherein an external surface of said rigid plate opposite said visco-elastic material is concave.

9. The golf clubhead of claim 1, wherein the center of said vibration damping means and the center of said at least one opening passing therethrough are radially offset.

10. The golf clubhead of claim 1, further comprising an aperture passing through said vibration damping means and extending radially outwardly from said at least one opening to an external contour of said vibration damping means.

11. The golf clubhead of claim 1, wherein a ratio of radial cross-sectional areas of said vibration damping means and said at least one opening is between about 0.1 and 0.9.

12. The golf clubhead of claim 11, wherein said ratio is about 0.5.

13. The golf clubhead of claim 1, wherein said constraining means comprises an annular rigid plate having a Young's modulus of at least 10,000 MPa and a thickness between 0.07 and 2.0 mm.

14. The golf clubhead of claim 13, wherein said at least one layer of visco-elastic material has a thickness of not more than 1.0 mm and an intrinsic damping coefficient, tan δ, between 0.4 and 1.2.

15. The golf clubhead of claim 1, wherein said constraining means comprises an annular rigid plate having a Young's modulus of at least 50,000 MPa and a thickness between 0.07 and 2.0 mm.

16. The golf clubhead of claim 15, wherein said at least one layer of visco-elastic material has a thickness of not more than 1.0 mm and an intrinsic damping coefficient, tan δ, between 0.4 and 1.2.

17. The golf clubhead of claim 1, wherein said constraining means comprises an annular rigid plate having a Young's modulus of at least 70,000 MPa and a thickness between 0.07 and 2.0 mm.

18. The golf clubhead of claim 17, wherein said at least one layer of visco-elastic material has a thickness of not more than 1.0 mm and an intrinsic damping coefficient, tan δ, between 0.4 and 1.2.

19. The golf clubhead of claim 1, further comprising a rear surface opposite to said front strike face, said rear surface defining a cavity located above the sole, a first portion of said rear surface that defines a forwardmost region of said cavity being substantially parallel to said front strike face, wherein said vibration damping means is provided on said first portion of said rear surface centered around the center of gravity of said clubhead.

20. The golf clubhead of claim 19, wherein said rear surface further comprises a second portion defining a lowermost region of said cavity opposite said sole, and said vibration damping means is provided on said first and second portions of said rear surface.

21. The golf clubhead of claim 19, wherein said first portion of said rear surface further comprises a recess, and a portion of said visco-elastic material extends into said recess.

22. The golf clubhead of claim 1, further comprising a hosel extending from said clubhead, and said vibration damping means is provided on said clubhead surrounding said hosel.

23. The golf clubhead of claim 1, wherein said vibration damping means is provided on said front strike face surrounding a central impact zone of said strike face.

24. The golf clubhead of claim 1, wherein said at least one layer of visco-elastic material comprises a plurality of layers, each layer having different visco-elastic properties.

25. The golf clubhead of claim 24, wherein said plurality of layers are stacked.

26. The golf clubhead of claim 24, wherein said plurality of layers are juxtaposed.

27. The golf clubhead of claim 1, wherein said at least one layer of visco-elastic material has a constant thickness.

28. The golf clubhead of claim 1, wherein said at least one layer of visco-elastic material has a variable thickness.

29. The golf clubhead of claim 1, wherein said vibration damping means comprises an annular rigid plate and at least one annular layer of visco-elastic material, and the thickness of said vibration damping means gradually varies.

30. The golf clubhead of claim 1, wherein said clubhead is a metal-wood.

31. The golf clubhead of claim 30, wherein said vibration damping means is provided within a cavity of said metal-wood clubhead.

32. The golf clubhead of claim 31, wherein said vibration damping means is provided on a back surface of said front strike face.

33. The golf clubhead of claim 30, wherein said vibration damping means is provided on a top surface of said metal-wood clubhead.

* * * * *